US010492988B2

(12) United States Patent
Schmoyer

(10) Patent No.: US 10,492,988 B2
(45) Date of Patent: Dec. 3, 2019

(54) STORAGE CONTAINER

(71) Applicant: David Schmoyer, San Diego, CA (US)

(72) Inventor: David Schmoyer, San Diego, CA (US)

( * ) Notice: Subject to any disclaimer, the term of this patent is extended or adjusted under 35 U.S.C. 154(b) by 0 days.

(21) Appl. No.: 15/652,366

(22) Filed: Jul. 18, 2017

(65) Prior Publication Data

US 2018/0185241 A1 Jul. 5, 2018

Related U.S. Application Data

(60) Provisional application No. 62/364,942, filed on Jul. 21, 2016.

(51) Int. Cl.

| | |
|---|---|
| ***A61J 1/03*** | (2006.01) |
| ***A61J 7/04*** | (2006.01) |
| ***A47B 81/00*** | (2006.01) |
| ***A61J 7/02*** | (2006.01) |

(52) U.S. Cl.

CPC ..... *A61J 1/03* (2013.01); *A47B 81/00* (2013.01); *A61J 7/04* (2013.01); *A61J 7/02* (2013.01); *A61J 7/0418* (2015.05); *A61J 7/0436* (2015.05); *A61J 2200/74* (2013.01)

(58) Field of Classification Search

CPC ..... A61J 7/04; A61J 7/0436; A61J 2200/74; A61J 2205/20; B65D 83/04; B65D 21/0201; B65D 21/02; B65D 1/24; B65D 1/36; B65D 25/10; B65D 2543/00444; B65D 43/20; B65D 43/16; B65D 61/02; B65D 37/00; B65D 6/00; B65B 6/00

USPC ..... 206/538, 533, 521, 557, 528, 539, 540, 206/1.5; 220/69, 4, 524, 523, 507, 23.8, 220/23.2, 812, 810, 811, 346, 23.4, 213, 220/252, 351, 345.1, 259.5, 256.1; 221/75, 91, 92; 222/143, 629; 248/603, 248/615; 203/534; 116/308; 192/135; 49/40; 68/139, 13 R, 12.04

See application file for complete search history.

(56) References Cited

U.S. PATENT DOCUMENTS

| | | | | | |
|---|---|---|---|---|---|
| 2,579,761 | A * | 12/1951 | Schmidtke | D06F 37/10 | 192/135 |
| 2,864,526 | A * | 12/1958 | Buss | D06F 37/28 | 160/222 |
| 3,285,466 | A * | 11/1966 | Ellis | D06F 37/10 | 220/213 |
| 4,335,591 | A * | 6/1982 | Gillespie | D06F 33/02 | 68/12.23 |
| 4,381,059 | A * | 4/1983 | Schurman | A61J 7/04 | 116/308 |
| 4,616,752 | A * | 10/1986 | Ridgley | A61J 1/03 | 206/521 |
| 6,206,227 | B1 * | 3/2001 | Ferri, Jr. | B67D 7/0238 | 220/213 |
| 6,615,107 | B2 * | 9/2003 | Hubicki | A61J 7/0481 | 700/237 |

(Continued)

*Primary Examiner* — Robert J Hicks
*Assistant Examiner* — Matusala K Tewolde
(74) *Attorney, Agent, or Firm* — David B. Waller

(57) ABSTRACT

A storage device having a cylindrical housing with a first end, a second end and cylindrical side, wherein the ends are closed and the cylindrical side has one or more apertures. There is a cylindrical cover for each of the one or more apertures that slidably fit over the cylindrical side of the cylindrical housing and able to slide about the cylindrical side exposing or covering the one or more apertures.

10 Claims, 1 Drawing Sheet

(56) References Cited

U.S. PATENT DOCUMENTS

| | | | | |
|---|---|---|---|---|
| 6,733,095 | B1 * | 5/2004 | Rieb | A47B 46/00 312/122 |
| 8,381,911 | B2 * | 2/2013 | Buchner | B65D 83/04 206/530 |
| 2015/0152584 | A1 * | 6/2015 | Gasparini | D06F 39/003 8/137 |
| 2015/0272825 | A1 * | 10/2015 | Lim | A61J 1/03 340/5.2 |

* cited by examiner

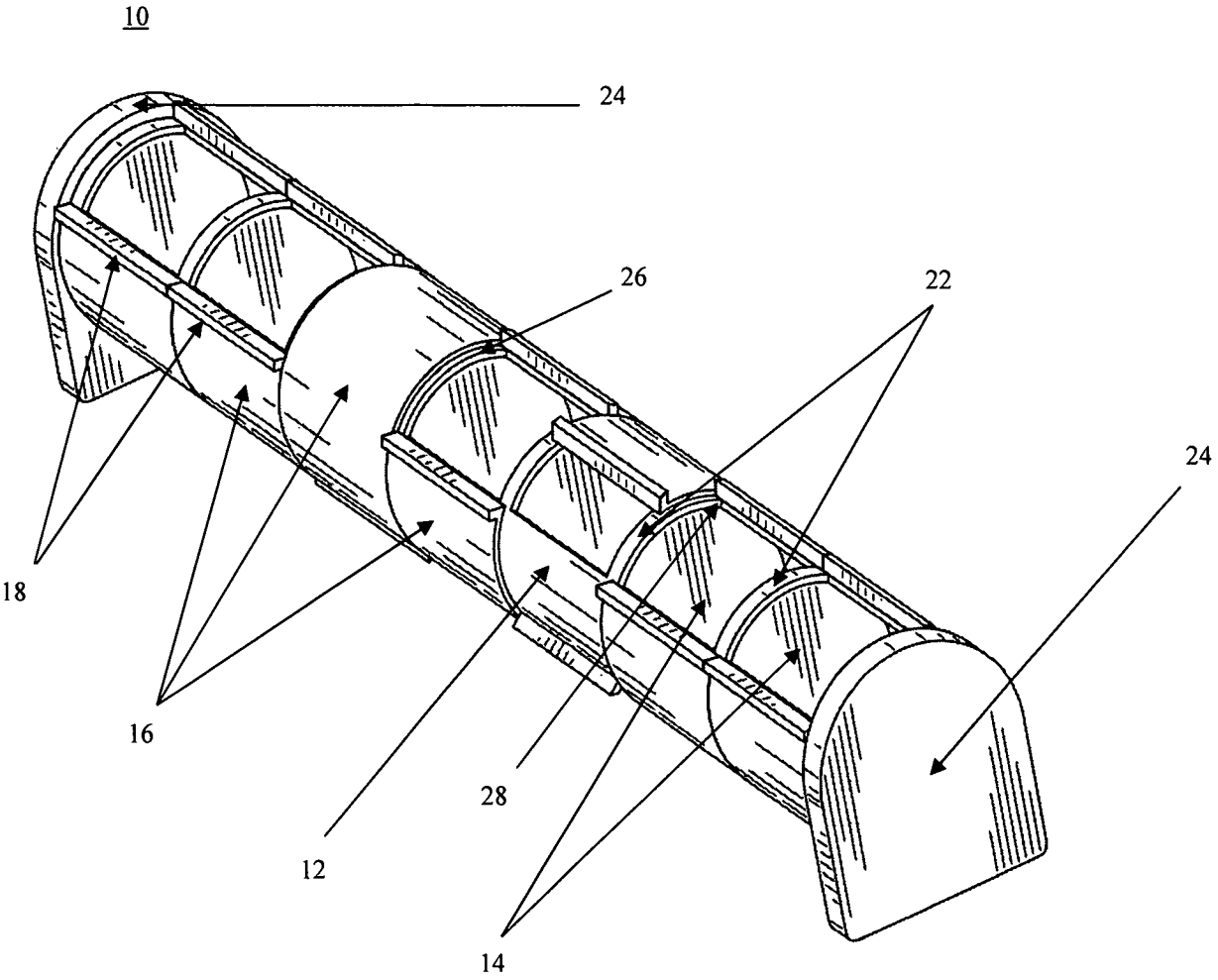
10
24
26
22
24
18
16
12
28
14

STORAGE CONTAINER

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates generally to devices for storing items. More specifically, a device for storing items on an assembly line, a work station, a garage, a desk, a countertop or the like wherein the items are small, requiring a storage area of about a cubic inch, such as nuts, small bolts or screws, medications or pills to larger items, that require a storage area of about a cubic meter, such as mechanical parts for automobile assembly, electronic parts for assembly of electronic devices, cabinetry parts for assembly of furniture and cabinets or the like.

BACKGROUND OF THE INVENTION

There are a number of devices commercially available for storing parts prior to or after use. Many of these devices have comparable configurations or are similar in many characteristics to storage containers used for medications and/or pills. When utilized for pill storage and dispensing, there are a number of problems that arise for individuals who suffer from arthritis or other diseases of the joints making fine motor skills with the fingers or grasping of the hands difficult and painful. Others suffer from the lack of strength which prevents them from opening vacuum sealed jars and child-proof caps easily. For some, whose medical conditions that extend into the joints of the wrists, elbows and shoulders, the twisting movements of opening a jar can be extremely difficult.

U.S. Pat. No. 4,253,572 discloses a multi compartment container for pills wherein each compartment may be broken away from the container and wherein each compartment has an air tight closure or lid with a flap that may be used to open and close the lid. Unfortunately, for many, and particularly those with arthritis, it is difficult and painful to leverage the lid open with a finger by exerting force on the lid flap. To resolve this problem, U.S. Pat. Nos. 4,378,885 and 4,432,300, are directed to a pill holder having a central chamber for maintaining the pills with a rotating cover, or top, which provides access to the chamber when an opening in the chamber and the cover are aligned. In use, the consumer must firmly grasp the device while at the same time twisting the top to align the openings and access the pills inside. These actions can be very difficult for an individual with advanced arthritis affecting both the fingers, wrists and elbows. In addition, the flexible plastic hinges that attach the lids to the container have a tendency to break over time from regular use or become less secure causing them to open unexpectedly spilling the medications or pills.

Other devices similar to those in U.S. Pat. Nos. 4,378,885 and 4,432,300, divide the central chamber radially into a number of compartments so that multiple medications may be stored and accessed individually (see U.S. Pat. Nos. 4,572,376 and 8,033,422). Unfortunately, these devices suffer from the same problems as U.S. Pat. Nos. 4,378,885 and 4,432,300; requiring both grasping strength and twisting ability.

Another device disclosed in U.S. Pat. No. 5,921,394 has a similar design. However, instead of having a chamber divided into compartments that rotate, it contains a rotating platform containing radial ribs defining the individual compartments that rotates within a cylinder having an access door. The radial ribs form two sides of the compartment while the cylinder provides the remaining side to complete the compartment. Unfortunately, this device suffers from the same problems as U.S. Pat. Nos. 4,378,885, 4,432,300, 4,572,376 and 8,033,422.

In another configuration, a pill dispenser is disclosed having an upright housing with a plurality of individual compartments, or drawers, wherein each column of drawers represents a day of the week and each row represents an hourly part of the day. The device comprises electronics which keeps track of the date and time and notifies the user when medications should be administered. In addition, each compartment has a hinged cover similar to that in U.S. Pat. No. 4,253,572 which can be difficult for an individual with arthritis to open.

Consequently, there is a need in the industry for a device that can be easily opened by the elderly or individuals suffering from arthritis or a condition like arthritis that does not require significant grasping strength coupled with a twisting motion or the fine motor skills of a finger to open a snap-on lid of a compartment.

The forgoing examples of related art and limitations related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described is a storage device comprising a cylindrical housing having a first end, a second end and cylindrical side wherein the cylindrical side has one or more apertures and wherein the ends are closed; and a cylindrical cover for each of the one or more apertures, wherein the cylindrical cover slidably fits over the cylindrical side of the cylindrical housing and able to slide about the cylindrical side exposing or covering the one of more apertures.

In one embodiment, the cylindrical cover has a front end and a back end and further comprises a grasping means on the front end, on the back end or on both the front and back ends. The grasping means may be a lip, a tab or a handle. The cylindrical side of the cylindrical housing may have a groove for each of the cylindrical covers and each of the cylindrical covers may have a ridge that fits within the groove to guide the cylindrical cover during sliding. The groove may further comprise a stop to prevent the cylindrical cover from sliding over the entire circumference of the cylindrical side. The cover may have an inner cylinder housing contact surface and an outer surface, wherein the inner cylindrical housing contact surface has a groove and the cylindrical housing has a ridge for each of the cylindrical covers that fits within the groove to guide the cylindrical cover during sliding. The groove may further comprise a stop to prevent the cylindrical cover from sliding over the entire circumference of the cylindrical side.

In another embodiment, the cylindrical housing may be separated into at least two or more chambers and each of the at least two or more chambers may have an aperture and each of the apertures may be associated with one cylindrical cover. For example, the cylindrical housing may be separated into at least seven chambers with each of the seven chambers having an aperture and wherein each of the apertures is associated with a cylindrical cover. Alternatively, the cylindrical housing may be separated by one or more fixed or adjustable dividers creating a plurality of chambers and each of the plurality of chambers has an aperture that may be associated with a cylindrical cover. The interior volume of each of the plurality of chambers may be about three cubic centimeters to about one cubic meter.

In yet another embodiment, the cylindrical cover may further comprise a locking mechanism, a spring loaded opening means, a closing control means or a remote controller for opening and closing the cylindrical cover.

In still another embodiment, the storage device further comprises a means for monitoring the number of items stored in any one of the plurality of chambers. The means for monitoring may be a mechanism that determines the number of the items in a chamber by weight. The storage device may further comprise a means for recording the number of times any one of the plurality of chambers is entered.

Another aspect of the present invention is a storage device wherein the cylindrical housing rotates and the cylindrical cover for each of the one or more apertures remain fixed.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures for carrying out the several purposes of the present disclosed device. It is important, therefore, that the claims be regarded as including such equivalent construction insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present.

BRIEF DESCRIPTION OF THE DRAWINGS

FIG. 1 shows one embodiment of a device of the present invention configured as a medication and/or pill storage container.

DETAILED DESCRIPTION OF THE INVENTION

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "aperture" or "apertures" "as used herein refers to an opening within the cylindrical housing that is of a size that allows one or more of the items stored in a given compartment of the storage device to be inserted into, replaced within or extracted from the compartment.

The term "grasping means" as used herein refers to an element of the cylindrical cover that allows the user to easily activate the sliding of the cylindrical cover over the cylindrical body and either exposing or covering one or more apertures in the cylindrical body. A grasping means may be any element that allows for this function such as a lip, knob or other protrusion provided on one or both ends of the cylindrical cover.

The term "locking mechanism" as used herein refers to any mechanism known in the art for securing a door, lid, top or cover to a container. In this case, the locking means is a method for locking the cylindrical cover in the closed, open or both the closed and open positions providing or preventing access to the compartment or compartments enclosed by the cylindrical cover. For example, the locking mechanism could be a simple snap-clip, a mechanical key lock or an electronic lock. Electronic locks may be activated by a specific magnetic field, an optical signal, an electrical signal or series of signals or finger print verification.

The term "spring-loaded opening means" as used herein refers to any mechanism that allows the cylindrical cover to be opened partially or completely with a minimum of assistance or without the assistance of the user. The term "spring-loaded" is used as a term of action and not be way of composition. More specifically, the spring-loaded opening means does not necessarily require a physical spring. It is the action that results when a spring is utilized for this function. Such means may be activated by a spring, hydraulic or pneumatic mechanism that achieves this action.

The term "closing control means" as used herein refers to any mechanism that allows the cylindrical cover, once activated to completely close securing the items within the one or more compartments secured by the cylindrical cover of the device. Such means may be activated by a spring, hydraulic or pneumatic mechanism that achieves this action.

The term "monitoring mechanism" as used herein refers to any method known to those skilled in that art for monitoring the presence and/or number of items within a given compartment of the device. There are a number of types of monitoring mechanisms that can be utilized and include those that determine the number of items in a compartment by weight, by optical viewing or scanning of the inside of the compartment or by monitoring signals from the items within the compartment by active or passive transmission. Active meaning that the items within the chamber emit a signal continuously that can be detected by the monitoring device or that the items respond to a signal instituted by the monitoring device.

The term "recording means" as used herein refers to any method known in the art for maintaining a record of when one or more items are removed from a compartment. Such a record could include the identification of the individual removing one or more items from the compartment, the date the one or more items were removed and the time. For example, the recording means could be a keycard/keycard scanner system.

I. Cylindrical Housing

The cylindrical housing 12 is an elongated cylindrical hollow tube of a specific length, internal diameter and wall thickness. The length of the cylindrical housing 12 will depend on its use and can range from about 6 inches to about 12 inches if used for a pill or medication holder/dispenser, from about 12 inches to about 36 inches if used for nut, bolts, washers, nails and screws or the like, from about 36 inches to about 72 inches if used for items such as electronic components for assembly of electronic devices like computers and greater than 72 inches if used for storing parts for assembly of vehicles, like cars, trucks, motorhomes, boats, planes, trains and the like.

The internal diameter will depend on the size and number of the items to be stored in a given compartment. One skilled in that art can make a determination of the diameter needed by considering the types of items that will be stored in the chambers. For example, if 27 (1 inch×1 inch×1 inch) cubes are to be stacked in three layers of nine cubes, then the diameter of the cylindrical housing could be calculated by multiplying the square-root (the diagonal of each cube) by 3 (the number of cubes along the diagonal of the three layers of cubes) or about 4.3 inches. For convenience the diameter could be provided from about 5 to about 8 inches or larger if desired. Such calculations can be performed by one skilled in the art to make the necessary determination of the cylindrical housing 12 diameter.

The thickness of the cylindrical housing 12 walls will depend on the weight and configuration of the items to be stored in a given compartment and the material from which the cylindrical housing 12 is prepared. If the items are heavy or have sharp protrusions, then a thicker wall resistant to penetration by tearing or puncture is desired. Correspondingly, if the cylindrical housing 12 were made of metal, then the thickness can be less than if it were made of polymer. One skilled in the art can determine which material would be best for housing particular items as well as make a determination as to the thickness of the wall to secure those items in a compartment. For example, if the device were to house pills or medications, then the cylindrical housing 12 could be made of a thin polymer or plastic. However, if the device 10 were to house ball bearings of significant weight it might be best to construct the cylindrical housing 12 of metal. An appropriate thickness of the metal could be determined based on the number of ball bearings to be housed in a given compartment.

The cylindrical housing 12 will have one or more apertures 14 or openings, which allow items to be easily placed in or taken out of a given compartment. The height of an aperture 14 or opening may be less than a 180° arc perpendicular to the length of the cylindrical housing 12 and can have a length of about four-fifths of the length of the cylindrical housing 12. Preferably there are two or more apertures 14. In other embodiments, there are seven or more apertures 14 and in other embodiments there are more than ten apertures 14. In one example, the height of the aperture 14 is about one-fourth the circumference of the cylindrical housing 12 and about 1 to 2 times that distance in width.

In a configuration where the storage device 10 comprises two or more compartments, dividers 22 are provided on either side of the apertures 14. The apertures 14 may be positioned so that they are centered on the area defining a compartment or they may be located to one side or the other of the compartment. The dividers 22 may be permanent or adjustable within the cylindrical housing 12 allowing the user to select particular sizes for each compartment as desired. If the dividers 22 are permanent they may be fabricated as part of the cylindrical housing 12, they may be adhered using adhesive, soldering, welding, brazing, by rivet, screw, bolt or other securing method known to those skilled in the art. A variety of methods known in the art may be utilized to provide adjustable dividers 22 within the cylindrical housing 12. For example, the internal surface of the cylindrical housing 12 may be provided with one or more guide grooves 26 and the dividers 22 provided with guide rails 28 that fit into the guide grooves 26. Dividers 22 may be slid into desired positions using these guides and secured for use.

The ends of the cylindrical housing 12 may further comprise end caps 24 that close off the openings on either end of the cylindrical housing 12. Each end cap 24 may further comprise a footing to assist in maintaining the cylindrical housing 12 in a desired orientation for ease of use. This may be accomplished in a variety of ways. For example, the end cap 24 may have a flat base that extends to or beyond the diameter of the cylindrical housing 12. In one embodiment, when the device 10 is used to store medicine or pills, the end caps 24 may be configured to be easily gripped with a hand that is arthritic or that has a similar medical condition that can cause discomfort when having to grip something tightly.

In addition, the cylindrical housing 12 near or around the apertures 14 may be provided with slide guides that interface with corresponding guide elements of the cylindrical cover 16 allowing the cylindrical cover 16 to be guided over the apertures 14 when sliding open or closed over the aperture 14 of a compartment. There are a variety of methods that may be used to guide the cylindrical cover 16 known to those skilled in the art. For example, one of more guide grooves 26 may be provided on the cylindrical housing 12 perpendicular to the length of the cylindrical housing 12 in which one or more guide rails 28 provided on the cylindrical cover 16 may engage when the device 10 is assembled and during use. Correspondingly, the guide grooves 26 may be provided on the cylindrical covers 16 and the guide rails 28 provided on the cylindrical housing 12. These guides may be provided such that the cylindrical cover 16 can slide over the entire circumference of the cylindrical housing 12 or stops may be provided so that the cylindrical cover 16 is restricted in its movement to only a portion of the circumference of the cylindrical housing 12. For example, the cylindrical cover 16 may be restricted to only slide along two-thirds or one-half of the circumference of the cylindrical housing 12. One skilled in the art can determine the extent to which the movement of the cylindrical cover 16 should be restricted and provide a stop at that location.

Alternatively or in conjunction with the slide guides, position guides may be provided along the circumference of the cylindrical housing 12 between the cylindrical covers 16 to bracket the cylindrical covers 16 and further maintain them in the desired location on the device 10 during use. The slide guides may be provided in a variety of configurations. In one configuration, the slide guides are merely ridges on the cylindrical housing 12 that extend from its outer surface to be flush with or rise above the upper surface of the cylindrical covers 16 and are positioned one on either side of each cylindrical cover 16.

II. Cylindrical Cover

The cylindrical covers 16 are provided in a size that covers one or more of the apertures 14 of the cylindrical housing 12. Consequently, the size of the cylindrical cover 16 may be at a minimum sufficient to cover a single aperture 14 opening in height and width. The cylindrical cover 16 may be larger in length if desired and may cover more than one aperture 14. It may also be larger in width but will be limited to a maximum size of slightly larger than a 180° arc of the cylindrical housing 12.

The cylindrical cover 16 may be made of the same or different material than the cylindrical housing 12. It may be opaque or it may be translucent so that items inside a compartment may be viewed. Alternatively, the cylindrical cover 16 may be opaque and have a translucent window for viewing. The window may be provided in any geometric configuration such as square, round or rectangular.

The underside of the cylindrical cover 16 may have a guide groove 26 or guide rail 28 that interfaces with the corresponding groove or guide on the cylindrical housing 12. If the cylindrical cover 16 contains a translucent window, the guide groove 26 and/or rails 28 may be provided one on either side of the window in the opaque region of the cylindrical cover 16 to prevent distortion when viewing the interior of the compartment. As suggested above for the cylindrical housing 12, a guide stop may be provided that prevents the cylindrical cover 16 from sliding over the entire circumference of the cylindrical housing 12. The guide stop may be provided on the cylindrical housing 12 or on the cylindrical cover 16.

The cylindrical cover 16 has two sides, a front end and a back end. Either or both of the front end and/or back end may further comprise a grasping means 18 to allow the user to easily raise and lower the cylindrical cover 16. The grasping means 18 may be integrated into or affixed onto one or both ends of the cylindrical cover 16. The grasping means 18 may also be a lip, a knob, a handle grip bar, or any similar device.

The cylindrical cover 16 may further comprise a locking mechanism 32 for securing the items within the compartments. For example, the locking mechanism 32 could be a simple snap-clip, a mechanical key lock or an electronic lock. Electronic locks may be activated by a specific magnetic field, an optical signal, an electronic signal or series of signals, or finger print verification. Any similar locking device known to those skilled in the art can be utilized with the present invention. The one selected will depend on the size of the device 10. For example, one skilled in the art would not likely select a fingerprint verification electronic lock for a small container configured to hold medications or pills. One skilled in the art would likely select a snap clip for holding the cylindrical covers 16 of the device 10 closed. However, such a container could be provided with such an electronic locking mechanism 32.

A number of means known in the art are available for controlling the opening and closing of the cylindrical cover 16. The term "spring-loaded" is used as a term of action and not be way of composition. More specifically, the spring-loaded opening means 34 does not necessarily require a physical spring. It is the action that results when a spring is utilized for this function. Such means may be achieved using a spring or a hydraulic or pneumatic mechanism. These devices may also be configured to be remotely activated. Such control may be performed by a variety of methods known in the art including a radio wave or infrared signal generator similar to remote television controllers.

III. Means for Monitoring Content

There are a variety of systems in use that monitor the content of an enclosure. The most popular are video cameras that record the ingress and egress of individuals or items contained in an enclosure. Another way involves detecting a change in the weight wherein a scale is integrated into the system on which the items are stored. Yet another way would be to identify a change in optical density of a group of items that may be relatively translucent by incorporating a light that emits an optical beam direct through the items stored. Depending on the items being stored, their weight, value, optical density, etc., one skilled in the art could decide which of a variety of methods known in the art could or should be used to monitor the ingress and egress of items stored in the compartment of the device.

IV. Means for Recording Entry to Compartment

There are a variety of methods known in the art for recording information about the ingress or egress of an item stored in a compartment of the device 10. Such devices include key card readers that require an individual to have access to a key card that provides information to the key card reader which then makes a determination of whether access should be granted. These devices are also able to record the individual accessing the compartment on what date and time. A video recording may also provide similar information by photographing the individual or individuals inserting or removing items from a compartment. This would require that a camera be mounted either in the compartment, outside the compartment near the cylindrical cover 16, or at a remote location and directed at the cylindrical cover 16 of interest. Depending on the level of security desired one skilled in the art could implement the appropriate method or methods.

Use

In one embodiment, the device is provided for housing medications and pills comprising seven or fourteen compartments and is from 7 to 14 inches in length. The cylindrical housing has seven or fourteen apertures, each with its corresponding cylindrical cover and end caps that allow the device to maintain its orientation on a flat surface and may be used to grip the device when opening a cylindrical cover if desired. Each of the cylindrical covers has a lip or tab on the front end for easily sliding the cylindrical cover over the cylindrical housing exposing the aperture under the cover. The user opens each compartment by sliding the cylindrical cover either up or down to expose the aperture. Once opened the user inserts the medications and/or pills into that compartment that correspond to a particular day of the week and then the cylindrical cover is slid back over the aperture closing the compartment. This is repeated for each of the days of the week. If desired and medications are prescribed twice daily, then the user also fills a second compartment for that given day with the appropriate pills or medication. When a day arrives that corresponds to one of the days provided by the device, the user merely lifts the cylindrical cover using the lip or tap on the front end exposing the aperture. The device is then tilted until all of the pills and/or medications in the compartment are removed. Alternatively, the user may grasp the device in one hand by one of the end caps and slides open the cylindrical cover with the other hand using the fingers. Once the pills and/or medications have been removed the cylindrical cover is slid over the cylindrical housing covering the aperture.

In another embodiment, the device is provided for housing electronic components for assembly of electronic equipment. In this case, the electronic device being assembled has five component parts and each part will require a 1 foot square storage area. Consequently, the storage device will be at a minimum 5 to 6 feet in length. The component parts have significant value and at the volumes being used they cannot be stored in an unsecured area. In addition, because the component parts are electronic, the device must be made of a non-conductive material such as polymer. In this configuration, the parts will require monitoring to assure that they are not stolen. Consequently, a key card is required to access the device. The user is issued a key card that identifies him or her in a database of employees or contractors. The card is inserted swiped or scanned to provide the information allowing or denying access. Once access is approved the cylindrical cover or covers may be lifted to access the items in the compartments. Once the items desired are removed, the cylindrical cover is closed and automatically locked. Depending on the size and weight of the cylindrical covers, additional systems may be employed to help the user lift them such as a spring, pneumatic or hydraulic lifters. Additional, safety precautions may be used that monitor the weight and therefore the content of each chamber to assure that only a single item is removed upon each entry. Video cameras incorporated within the compartments, on the cylindrical cover or cylindrical housing or on an adjacent wall directed at the device may also be used.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

I claim:

1. A storage device comprising:

a. a cylindrical housing having a first end, a second end and cylindrical side wherein said cylindrical side has one or more apertures, wherein said ends are closed, wherein said closed ends each provide a footing for said storage device, wherein said footing extends to or beyond the ends of said cylindrical housing, wherein said cylindrical housing further comprises one or more adjustable dividers creating a plurality of chambers and wherein each of said plurality of chambers having said one or more apertures; and b. a cylindrical cover for each of said one or more apertures, wherein said cylindrical cover slidably fits over and partially encircles and overlaps said cylindrical side of said cylindrical housing and able to slide about said cylindrical side exposing or covering said one or more apertures, wherein said cylindrical cover can slidably rotate 360 degrees in either direction to close or expose each of said one or more apertures, wherein said cylindrical cover encircles and overlaps about 270 degrees of said cylindrical side of said cylindrical housing, wherein the cylindrical side of said cylindrical housing has a groove for each of said cylindrical covers and each of said cylindrical covers has a ridge that fits within said groove to guide said cylindrical cover during sliding or wherein the cylindrical cover has an inner surface that contacts the cylindrical housing and an outer surface, wherein said inner surface has a groove and said cylindrical housing has a ridge for each said cylindrical covers that fits within said groove to guide said cylindrical cover during sliding.

2. The storage device according to claim 1, wherein said cylindrical cover has a front end and a back end and further comprises a grasping means on said front end, on said back end or on both said front and back ends.

3. The storage device according to claim 2, wherein said grasping means is a lip, a tab or a handle.

4. The storage device according to claim 1, wherein said cylindrical housing is separated into at least two or more chambers and wherein each of said at least two or more chambers each contains one of said aperture and wherein each of said apertures is associated with one said cylindrical cover.

5. The storage device according to claim 1, wherein each of said plurality of chambers has an interior volume of about three cubic centimeters to about one cubic meter.

6. The storage device according to claim 1, further comprising a means for monitoring items stored in any one of said plurality of chambers.

7. The storage device according to claim 6, wherein said means for monitoring is a mechanism that determines the number of said items by weight.

8. The storage device according to claim 1, further comprising a means for recording the number of times any one of said plurality of chambers is entered.

9. The storage device according to claim 1, wherein said cylindrical housing rotates and said cylindrical cover for each of said one or more apertures remain fixed.

10. The storage device according to claim 4, wherein said cylindrical housing is separated into at least seven chambers or a multiple of said seven chambers and wherein each of said seven chambers or a multiple of said seven chambers has an aperture and wherein each of said apertures is associated with one said cylindrical cover.

* * * * *